United States Patent [19]

Duchene

[11] Patent Number: 4,661,123

[45] Date of Patent: Apr. 28, 1987

[54] KILN FOR TREATING BITUMINOUS SCHISTS

[76] Inventor: Paul R. Duchene, 3 rue Saint Jean Marie Vianney, 78100 St Germain En Laye, France

[21] Appl. No.: 600,367

[22] Filed: Apr. 16, 1984

[30] Foreign Application Priority Data

Apr. 21, 1983 [FR] France ..... 83 06531

[51] Int. Cl.[4] ..... C01S 3/16

[52] U.S. Cl. ..... 48/76; 48/63; 202/85; 202/88; 202/95; 202/215; 202/223

[58] Field of Search ..... 206/88, 85, 95, 99, 206/108, 208, 215, 223, 121, 134, 151; 201/44, 37, 38; 208/11 R, 8 R; 48/63, 76, 64, 67, 69, 68

[56] References Cited

U.S. PATENT DOCUMENTS

| | | | |
|---|---|---|---|
| 1,894,691 | 11/1925 | Karrick | 201/38 |
| 1,975,396 | 10/1934 | Jenson | 202/88 |
| 2,131,702 | 9/1938 | Berry | 201/44 |
| 2,448,223 | 8/1948 | Lantz | 202/99 |
| 2,560,767 | 7/1951 | Huff | 208/11 R |
| 3,847,752 | 11/1974 | Oleszeko et al. | 202/151 |
| 4,007,093 | 2/1977 | Doilov et al. | 201/44 |
| 4,115,202 | 9/1978 | Loreny et al. | 202/99 |
| 4,152,243 | 5/1979 | Legille et al. | 202/262 |
| 4,248,670 | 2/1981 | Loreny et al. | 202/99 |

FOREIGN PATENT DOCUMENTS

| | | | |
|---|---|---|---|
| 343048 | 5/1917 | Fed. Rep. of Germany | 202/121 |
| 382613 | 10/1923 | Fed. Rep. of Germany | 202/121 |
| 2263290 | 3/1975 | France . | |
| 158394 | 11/1919 | United Kingdom | 202/121 |

*Primary Examiner*—Peter Kratz

*Attorney, Agent, or Firm*—Ostrolenk, Faber, Gerb & Soffen

[57] ABSTRACT

A kiln having pyrolysis, gasification and cooling horizontal zones, divided over its height into vertical chambers by vertical dividing walls, and having flues with vents housed in the dividing walls and the walls of the outer enclosure for injecting reaction fluids and fumes and for drawing off gases and vapors.

In the gasification zone, the dividing walls have diffusion panels adjacent diffusion chambers. The panels are connected to the reaction fluid supply and are of a height which corresponds substantially to the height of the panel.

The vertical chambers form modular cells through which the granulated mineral flows continuously without encountering obstructions in the form of irregularities.

7 Claims, 5 Drawing Figures

KILN FOR TREATING BITUMINOUS SCHISTS

BACKGROUND OF THE INVENTION

The present invention relates to a kiln for treating bituminous schists comprising a pyrolysis zone followed by gasification and cooling zones, the kiln being supplied by injecting gas and fumes, hot or cold, water, vapor, and air.

A prior gas producing kiln of this type, described for example in French Pat. No. 2 263 290 in the name of the applicant, comprises at its upper part a device for feeding rocks to be treated and an outlet for the gases coming from the reaction zone, gas intakes required for the gasification reaction, the gasification zone being subdivided by vertical dividing walls provided with reaction fluid injection means at several levels.

SUMMARY OF THE INVENTION

The invention provides an improvement over such a kiln in that it is subdivided over the whole of its height into vertical chambers by means of refractory material dividing walls, and has flues for injecting reaction fluids and fumes and for drawing off gases and vapors being housed in the dividing walls and in the walls of the enclosure of the kiln.

Thus, the kiln has parallel vertical modular compartments able to be juxtaposed in a large number so as to form high capacity production units.

This geometry of the kiln allows the modular cells or compartments to be increased depending on the desired production capacity. The study of a large capacity unit may be conducted from an experimental module for, whatever its position in the kiln, each modular cell is subjected to operating conditions comparable to the other cells.

The cells receive the granulated mineral continuously at their upper part, the material flows through the cells from top to bottom without meeting any obstructions, to arrive at the base of the kiln, after pyrolysis, and after losing its oils, residual carbon and organic residues. The surfaces of the walls of the cells are smooth. Each cell has mineral over the whole of its section, so that no rough indentations on the sidewalls due to caving in can occur in the active zone.

Since the walls separating the cells are made from refractory materials, such as bricks, shaped pieces or refractory concrete, they form a considerable thermal mass buried in the material to be treated, acting thermal regulator by absorbing and restoring the heat depending on the internal variations of the temperature in the active zones of the kiln and thus providing excellent thermal stability.

Furthermore, the mass of the refractory materials of the walls and dividing walls of the kiln play an important catalytic role in the gasification zone, in particular in the formation of carbon oxide by reaction of carbon dioxide on carbon.

In a preferred embodiment, the dividing walls are formed in the gasification zone by diffusion panels fed with reaction fluids from adjacent diffusion chambers whose height corresponds substantially to the height of the panels.

Such diffusion panels may be formed preferably by open porosity panels, whose degree of permeability is at least 50% or by refractory panels with multiple perforations, for example on the order of 100 perforations per square meter of a centimeter in diameter. The panels thus formed let the gases and the vapors diffuse over the whole of their surface at very slow speeds, for example on the order of 0.06 m/second, and therefore the material in contact or in close vicinity of the walls is not subjected to untimely cooling, whereas the reaction speed of the residual carbon, which becomes oxidized in contact with the oxygen of the air arriving at a moderate rate, compensates the cooling due to the blast by the heat released. The homogeneity of the desired level of the reaction temperatures is thus ensured in the mass of a materials, whatever the position of the grains with respect to the intake source of the reactive gases.

The diffusion planes formed by panels provide a sufficient pressure drop, during passage of the gases and vapors, to create an internal pressure in the flues equal at all points and thus makes the diffusion through the walls identical over the whole surface of the planes concerned. In addition, the diffusion of the air and of the reactive gases and vapors through panels eliminates the preferential paths which would persist as far as the pyrolysis zone. This provides good deoxygenation of the gases and fumes coming from the gasification zone, thus improving the oil yield of the pyrolysis and the quality of the oils obtained, without any risk of oxidation during formation thereof.

BRIEF DESCRIPTION OF THE DRAWINGS

Other features of the invention will be clear from the following description of one embodiment of the kiln according to the invention with reference to the drawings in which.

DESCRIPTION OF THE PREFERRED EMBODIMENT

Figure 1:
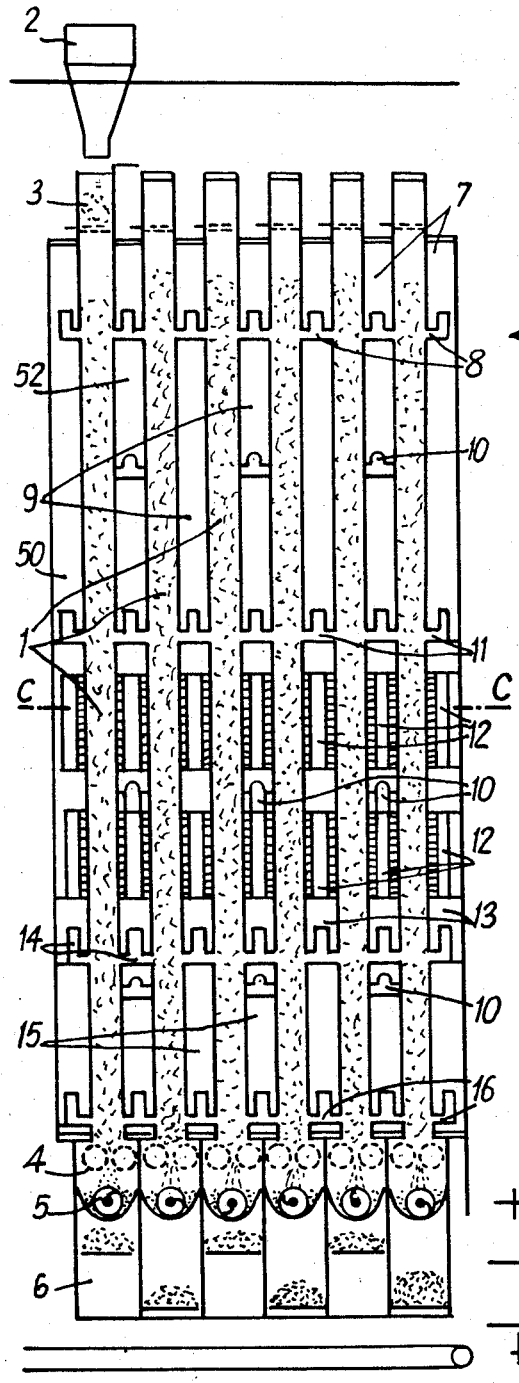
FIG. 1 shows a vertical sectional view along line A—A of FIG. 3.

The kiln, having a rectangular section and a height of 13 m, is formed by an enclosing wall 50 having external heat-insulated walls 51, the inside of which is divided by dividing walls 52 into vertical cells or chambers 1 whose cross section is 0.4 m by 10 m. Thereon is mounted a mobile hopper 2 which feeds an air lock at the top of each cell 1. At its lower part, each cell is provided with a continuous operation extractor 4 formed by a pair of grooved metal rollers. Under each pair of rollers, a trough with an endless groove 5 discharges the spent schist towards a sealed discharge airlock 6.

Each wall 50 and dividing wall 52 comprises, from top to bottom;

sealed wall or dividing wall parts made from prefabricated molded and vibrated refractory concrete elements 7, 9, 13 and 15 defining respectively the neutral zone for filling the cells, the pyrolysis zone, the separation zone between the gasification zone and the cooling zone and the cooling zone itself, a flue 8 constructed from shaped refractory pieces, having a single ramp, when it is housed in wall 50 of the enclosure and a double ramp of vents 54, when it is housed in a dividing wall 52 for discharging the distillation products of the schists, a flue 11, of similar construction, for drawing off the excess producer gases produced in the gasification zone and for injecting hot and neutral fumes during start up of the unit, flues 14 and 16, of similar construction, used respectively for sucking and injecting the gases and fumes for cooling the treated schists, two diffusion chambers 12 constructed from shaped refractory parts 17 for distributing, through porous walls 18, the air, water vapor and fumes required for the gasification-combustion of the schist layer between the walls of cells 1, tunnels 10 provided with double window ramps 55 made from shaped refractory parts open at both ends for placing measuring and checking apparatus.

Walls 50 and dividing walls 52 in their parts other than those corresponding to the gasification zone are formed by hollow prefabricated multiple vibrated refractory concrete elements, the walls being lined with a heat insulating layer 51.

Figure 2:
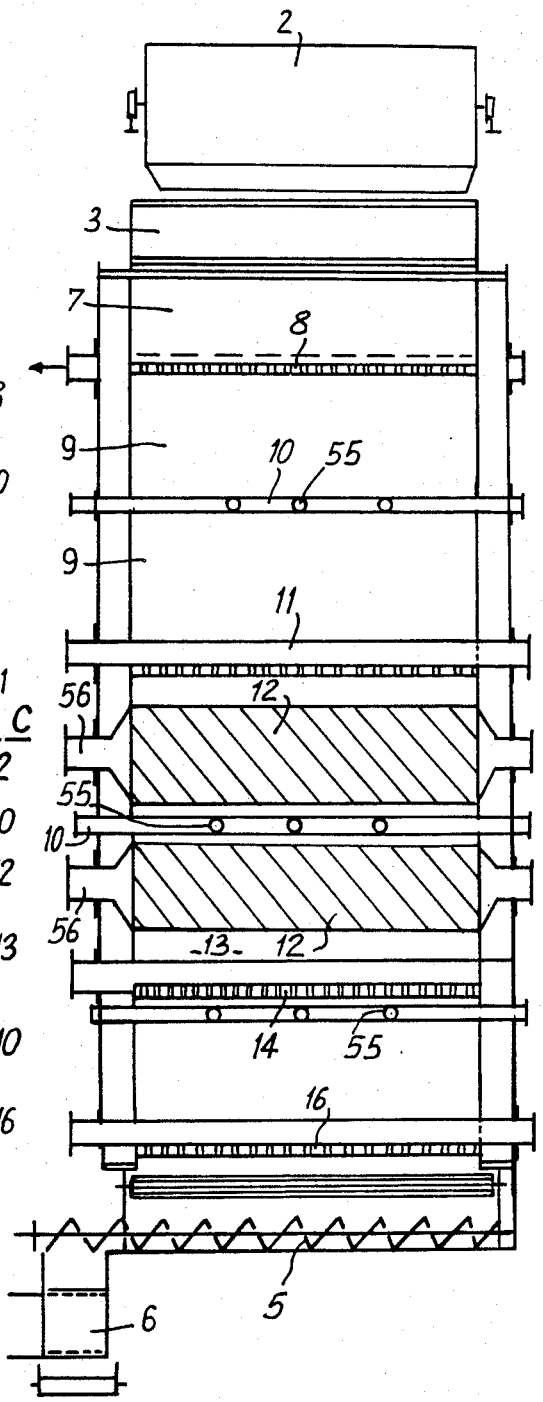
FIG. 2 is a vertical sectional view along B—B of FIG. 3.
Figure 3:
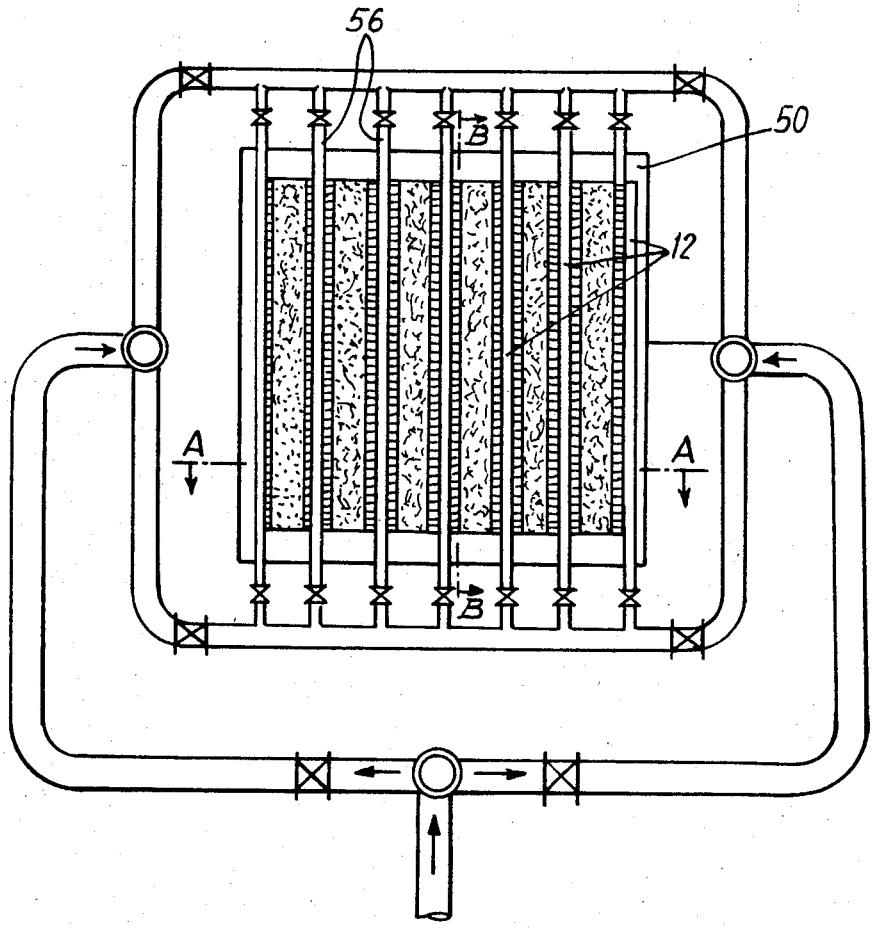
FIG. 3 is a horizontal sectional view along C—C of FIG. 1.
Figure 4:
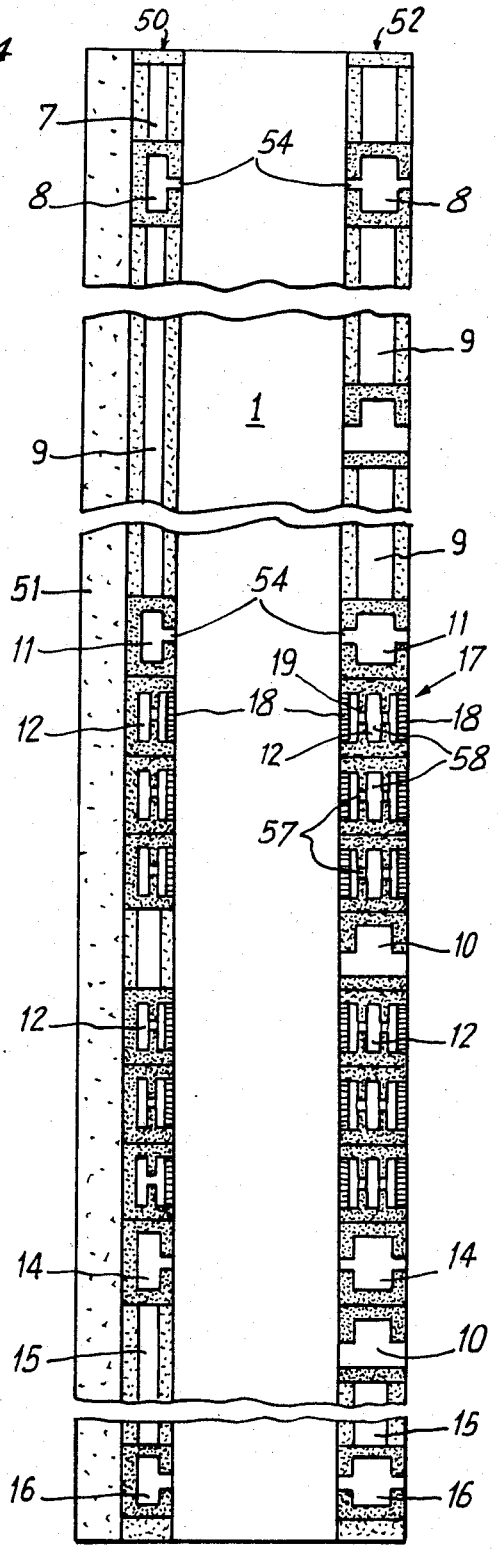
FIG. 4 is a sectional view of a vertical chamber.
Figure 5:
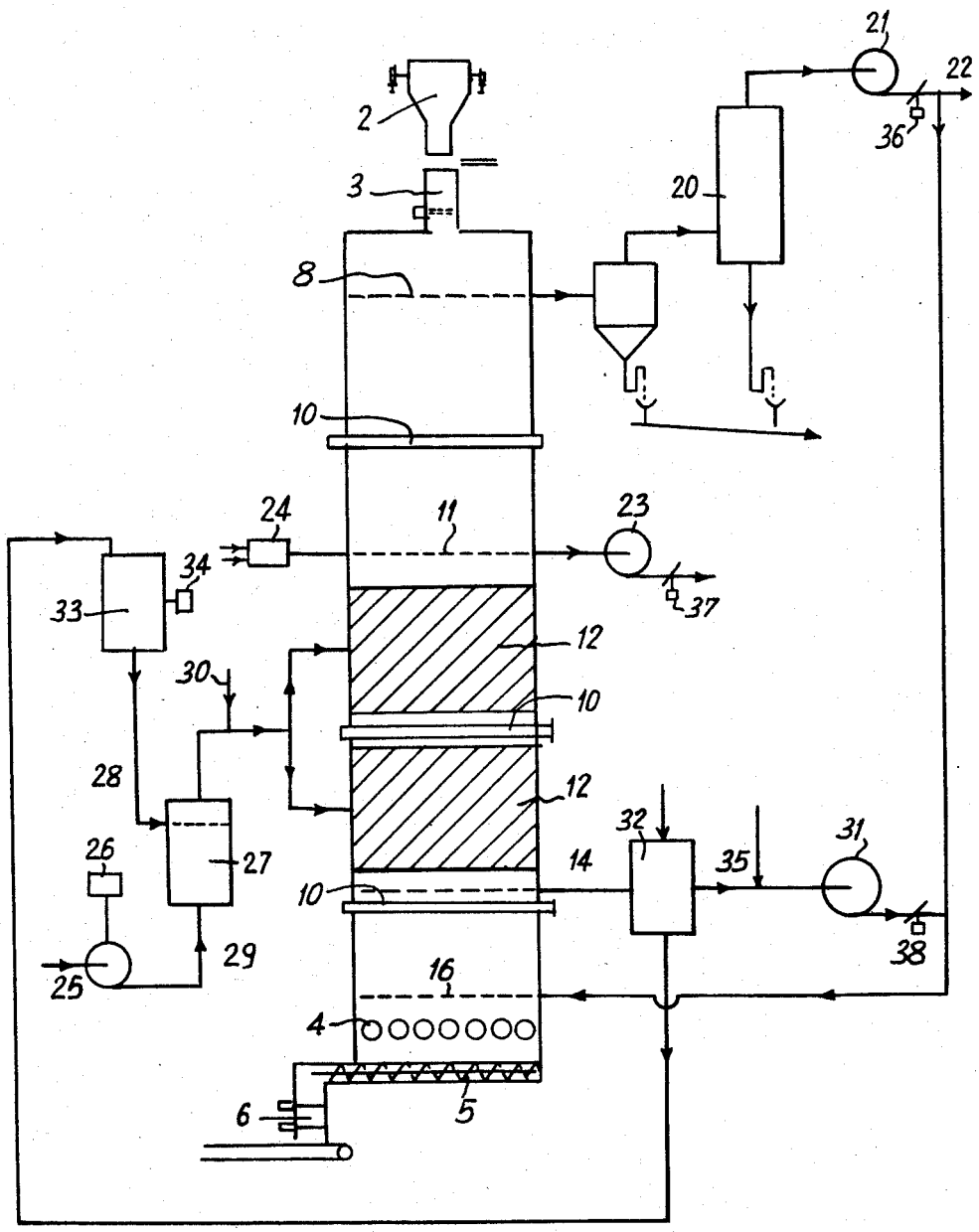
FIG. 5 is a general diagram of the installation.

At the level of the gasification zone, the cells are defined on each side by diffusion chmbers 12 shown schematically in FIGS. 1 and 2. These chambers are fed with reaction fluid by pipes 56 which open into chambers through a bell-mouthed part. The gasification zone of a height of about 3 m comprises two superimposed sections 12 separated in one dividing wall out of two by a tunnel 10. Chambers 12 are formed by shaped parts 17 which fit together by means of tenons and mortices in the longitudinal and vertical direction so as to form, on the one hand, a continuous support 19 for the vertical porous walls 18 and, on the other hand, so as to form horizontal rectilinear flues 58 fed with air and vapor through their two ends. In an exterior wall flue, the vertical wall 19 on the chamber side is pierced with a line of vents 57, whereas for a dividing wall flue, each of the two vertical dividing walls 19, each corresponding to a chamber, is pierced with a line of vents. The vents are equipped with nozzles.

Each shaped part comprises an extension at its upper part and at its lower part provided with a sliding mortice for fixing the porous panels 18.

The porous panels are made from a material whose porosity is at least 50% and may be manufactured, for example, from a clay mass containing materials which are volatilizable by combustion.

The porous panels may be replaced by panels with multiple perforations, comprising for example 100 perforations per square meter of surface of a centimeter in diameter. Other methods of fixing these panels to shaped refractory parts are also possible, for example by means of simple ties conferring on the whole a good mechanical strength.

The external organization of the kiln comprises essentially:

an apparatus for dehumidifying, condensing and extracting condensible products resulting from the pyrolysis of the schists (20). It is connected to both ends of ramps 8. An extractor fan (21) provides the suction. The gases are distributed through a lyre shaped expansion pipe to the different points of use.

an extractor fan (23) for removing the excess gases from the gasification-combustion zone connected to both ends of the ramps (11).

This device is used during operation of the kiln and isolated during start up of the kiln.

a hot and neutral fume generator (24) using external fuel for providing start up of the kiln by direct heating thereof in contact with the schist contained in the pyrolysis zone. This generator is isolated during the period of operation.

an assembly for feed control, weighing, regulation and distribution of the air, of the water vapor, of the reaction gases and fuels required in the gasification zone, the distribution of which is connected to the ends of the diffusion chambers (12). This assembly for the weight feed control of the gaseous fluids comprises essentially:

an air booster (25) sucking in the atmospheric air, a weight regulator of sucked in air (26) in modulation with the booster (25).

an air humidifier-saturator (27) operating on hot water at an adjustable and constant temperature depending on the amount of water vapor desired to be introduced into the gasification-combustion chamber. Items (28), (29) and (30) show, with their regulating meters, the intakes for the hot water, the water vapor, the gases or fumes which it is desired to introduce into the reaction system of the gasification-combustion zone.

an assembly for cooling the spent schist so as to allow recovery of the tangible heat and to lower the temperature sufficiently for facilitating emptying of the kiln. This assembly is formed by a fan (31), which sucks in the gases at the ends of the ramps (14). It is provided by a heat exchanger (32) and a hot water generator. The latter may be used, for example, for conditioning air saturated with the humidifier (27) connected to the hot water reserve (33) regulated by (34) to a constant temperature, or else it may be intended for other uses.

The gases cooled at (32) are mixed at (35) with incondensible gases from the kiln. They are then injected at both ends of the ramps (16). They pass through the spent schist to be cooled by direct contact. A large part is taken up again by sucking at ramps (14). A small part is lost in a rising movement through the mass of materials, through the buffer zone, before penetrating into the gasification zone of the kiln.

a pressure regulator (36) is operational at the output of the extractor fan (21) for maintaining the cells of the kiln with a very slight over pressure at the top thereof.

pressure regulators (37, 38) are situated at the outlet of the extractor fans (23) and (21) for maintaining the working pressure of a kiln constant in the zones considered.

In an installation comprising a kiln in accordance with the example described above formed by a tank with parallel sides, said tank being divided into six vertical chambers wit internal dimensions of 0.4 m width, 10 m in length and 13 m in height, each height is divided up as follows:

| | |
|---|---|
| charging zone | 1 m |
| pyrolysis zone | 6 m |
| ignition and gas tapping zone | 0.5 m |
| gasification zone | 3 m |
| cooling zone | 2.5 m |

a test was carried out for treating Würtemberg schists having the following characteristics:

| | |
|---|---|
| crude schist: | granulation 5 to 40 mm |
| | humidity 4–5% |
| | true specific weight 2.2 |
| | apparent specific weight 1.3 |
| dry schist: | Fischer's test (520° C., 60 min) |
| | oil 4.35% |

-continued

| | |
|---|---|
| | gas 2.5%, i.e. 22.7 $nm^3$/ton |
| | constitution water 1% |
| | mineral residue 95.1% |
| composition of the residue: | fixed carbon 4.9% |
| | mineral residue 95.1% |

The supply per chamber is 150 t/day and the gas and vapor volume collected is 1200 $m^3$ per ton of schist, i.e. 180,000 $m^3$. The operating conditions are the following:

| | |
|---|---|
| temperature in the pyrolysis zone | 500° C. |
| temperature in the gasification zone | 800-850° C. |
| temperature of the gases at the outlet | 150° C. |
| temperature of the residue after cooling | 50° C. |
| consumption per ton of schist | |
| of air | 380 $nm^3$ |
| of water vapor | 250 kg or 311 $nm^3$ |
| of recycled gas | 240 $nm^3$. |

The composition of the gases in percentages is the following:

| | | | |
|---|---|---|---|
| $CO_2$ | 23 | $H_2$ | 6 |
| $H_2S$ | 1.4 | $CH_4$ | 0.3 |
| $SO_2$ | 0.8 | Ethylene carbides | 0.4 |
| $O_2$ | 0.2 | $N_2$ | 67.9 |

Although the present invention has been described in connection with a preferred embodiment, many variations and modifications will become apparent to those skilled in the art. It is preferred, therefore that the present invention be limited not by the specific disclosure herein, but only by the appended claims.

What is claimed is:

1. A kiln for treating bituminous schists with air and steam, having a top and bottom defining the height of said kiln therebetween, having outer enclosure walls and inner vertical partition walls made from refractory material, said outer enclosure walls defining the length of the kiln therebetween, said outer enclosure walls and inner vertical partition walls comprising the boundaries for vertical schist treatment chambers, said vertical schist treatment chambers comprising columnar vertical voids each extending across said kiln and along the height of said kiln;

a plurality of said chambers having a substantially equal and constant cross-section over their entire height;

said inner partition walls and said outer enclosure walls having substantially horizontal flues comprising a plurality of aligned voids formed in said walls extending across the width of said kiln for supplying reaction gases to, and withdrawing distillation products from, the chambers through vents, said vents comprising a plurality of openings extending through said walls, said kiln comprising, from top to bottom:

(a) means defining a pyrolysis zone comprising a first portion of said kiln, said pyrolysis zone bounded by and including on its upper side a first horizontal flue for withdrawing distillation products, and bounded by and including on its lower side a second horizontal flue for drawing off excess gas and for injecting hot fumes during the start-up of said kiln;

(b) means defining a gasification zone comprising a second portion of said kiln located below said second horizontal flue and having a plurality of hollow diffusion chambers formed in said outer enclosure walls and in said partition walls, said diffusion chambers comprising a plurality of columnar horizontal voids each extending across the width of said kiln gasification zone, the outer diffusion chambers formed in said outer enclosure walls having a diffusion wall on their inner sides, the inner chambers formed in said partition walls having diffusion walls on each of their sides oppositely facing adjacent schist treatment chambers, the walls housing said diffusion chambers comprising porous slabs of at least 50% porosity extending along the height of said gasification zone, said diffusion chambers supplying air and steam to be diffused inside said gasification zone; and (c) means defining a cooling zone located below said means defining a gasification zone and comprising a third portion of said kiln, said cooling zone having a third horizontal flue for withdrawing gases and fumes, and a fourth horizontal flue for injecting gases and fumes.

2. The kiln as recited in claim 1, wherein said second flue is connected to means for preheating the schists in the pyrolysis zone during start-up of said kiln.

3. The kiln as recited in claim 1, wherein said first flue is connected to an extractor fan which provides the suction to withdraw said distillation products.

4. The kiln is recited in claim 1, wherein said second horizontal flue is connected to an extractor fan for drawing off said excess gas.

5. The kiln as recited in claim 1, wherein said gasification zone of said kiln is connected to an assembly for regulating the distribution of air and water applied through said diffusion chambers.

6. The kiln as recited in claim 5, wherein said assembly comprises:

(1) an air booster for sucking in atmospheric air and a regulator for controlling said booster; and (2) an air humidifier for converting hot water into water vapor at a constant temperature for introduction into said gasification zone.

7. The kiln has recited in claim 1, wherein said third horizontal flue is connected to a fan for withdrawing gases and fumes from the schists, said third horizontal flue also connected to a heat exchanger for cooling said gases and fumes, and a conduit connected to said heat exchanger for reintroducing the cooled gases and fumes to said kiln via said fourth horizontal flue.

* * * * *